US009707693B2

(12) United States Patent
Lee

(10) Patent No.: US 9,707,693 B2
(45) Date of Patent: Jul. 18, 2017

(54) SELF-CONTAINED DOCKING ARRANGEMENT FOR HEAD SAW MACHINE

(71) Applicant: Chao-Ying Lee, Riverside, CA (US)

(72) Inventor: Chao-Ying Lee, Riverside, CA (US)

( * ) Notice: Subject to any disclaimer, the term of this patent is extended or adjusted under 35 U.S.C. 154(b) by 0 days.

(21) Appl. No.: 15/062,169

(22) Filed: Mar. 6, 2016

(65) Prior Publication Data

US 2016/0257021 A1 Sep. 8, 2016

Related U.S. Application Data

(60) Provisional application No. 62/129,262, filed on Mar. 6, 2015.

(51) Int. Cl.

| | |
|---|---|
| ***B27B 9/00*** | (2006.01) |
| ***B27B 5/32*** | (2006.01) |
| ***B27G 19/04*** | (2006.01) |
| ***B27B 7/00*** | (2006.01) |
| ***B25F 5/02*** | (2006.01) |
| ***B25H 3/00*** | (2006.01) |

(52) U.S. Cl.

CPC ..... *B27B 9/00* (2013.01); *B25F 5/02* (2013.01); *B25H 3/006* (2013.01); *B27B 5/32* (2013.01); *B27B 7/00* (2013.01); *B27G 19/04* (2013.01)

(58) Field of Classification Search

CPC ..... B27B 9/00; B27B 7/00; B27G 19/04
USPC ..... 83/574; 30/371, 388, 263, 264, 275.4
See application file for complete search history.

(56) References Cited

U.S. PATENT DOCUMENTS

| | | | | |
|---|---|---|---|---|
| 3,738,208 | A * | 6/1973 | Hartzell | B27B 5/29 83/403.1 |
| 3,943,808 | A * | 3/1976 | Pryor | B23Q 1/0009 83/88 |
| 4,063,982 | A * | 12/1977 | Bourke | B28D 1/003 156/254 |
| 4,163,404 | A * | 8/1979 | Lavis | B23Q 1/48 83/165 |
| 4,584,918 | A * | 4/1986 | Stubbe | B27B 5/207 83/471.3 |
| 4,611,521 | A * | 9/1986 | McCardle | B27B 17/0058 30/382 |
| 4,726,274 | A * | 2/1988 | Pitoni | B23Q 9/0014 83/574 |
| 5,140,754 | A * | 8/1992 | Martenson | B27G 19/04 30/390 |
| 5,213,020 | A * | 5/1993 | Pleau | B23D 47/005 83/828 |

(Continued)

OTHER PUBLICATIONS

Simonds Product Line Website. http://www.amludwigsawshop.on.ca/headsaws.htm.*

*Primary Examiner* — Sean Michalski
(74) *Attorney, Agent, or Firm* — Raymond Y. Chan; David and Raymond Patent Firm

(57) ABSTRACT

A head saw machine includes a head saw body, a self-contained docking arrangement to perform a handhold position and a self-stand position to the head saw machine, a motor having an output line, a cutting blade rotatably connected with an output link of the motor, a front handle attached adjacent a front end of the head saw body, and a rear handle integrally extended from a position adjacent to a rear end of the head saw body, which allow the user holding thereon.

23 Claims, 6 Drawing Sheets

(56) References Cited

U.S. PATENT DOCUMENTS

| | | | | | |
|---|---|---|---|---|---|
| 5,746,193 | A * | 5/1998 | Swan | B28D 1/042 | 125/13.03 |
| 6,128,994 | A * | 10/2000 | Phelps | B27B 7/00 | 144/378 |
| 6,192,592 | B1 * | 2/2001 | Zimmerman | B23Q 9/0028 | 30/371 |
| 6,305,259 | B1 * | 10/2001 | Whitworth | B23D 45/046 | 83/113 |
| 6,378,219 | B1 * | 4/2002 | Hatlee | B23D 45/042 | 30/276 |
| 6,688,197 | B1 * | 2/2004 | Niemela | B23D 53/001 | 144/28.6 |
| 7,293,489 | B1 * | 11/2007 | Wood | B23D 45/042 | 144/285 |
| 8,291,800 | B2 * | 10/2012 | Chang | B23D 45/048 | 200/50.01 |
| 8,919,235 | B2 * | 12/2014 | Sudou | B23D 45/042 | 83/471.2 |
| 9,003,940 | B2 * | 4/2015 | He | B27B 5/165 | 83/471.2 |
| 9,221,110 | B2 * | 12/2015 | Guth | B23D 45/16 | |
| 9,242,390 | B2 * | 1/2016 | Nicholson | B27B 9/02 | |
| 9,457,461 | B2 * | 10/2016 | Francis | B23D 45/16 | |
| 9,591,812 | B2 * | 3/2017 | Schmotter | A01G 23/095 | |

* cited by examiner

SELF-CONTAINED DOCKING ARRANGEMENT FOR HEAD SAW MACHINE

CROSS REFERENCE OF RELATED APPLICATION

This is a regular application that claims priority to U.S. provisional application No. 62/129,262, filed on Mar. 6, 2015, the entire contents of each of which are expressly incorporated herein by reference.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a cutting machine, such as a head saw machine, and more particularly to a head saw machine with a self-contained docking arrangement for supporting the head saw machine standing on its own.

Description of Related Arts

A conventional cutting machine, such as a head saw machine, usually comprises a utility table for supporting a workpiece placed thereon, a cutting head assembly having a cutting blade which is overhangingly and rotatably supported above the utility table, and a motor electrically connected with the cutting head assembly for driving the cutting blade to rotate to cut the workpiece which is rested on the utility table.

However, the above mentioned head saw machine has the following drawbacks. Since the cutting head assembly, the workpiece and the motor are supported on the utility table, the structure of the utility table is designed relatively large and rigid in order to provide a better supporting ability. In other words, a weight of the above mentioned head saw machine is relatively heavy. In addition, a large display space is needed to perform the operation for the head saw machine. Therefore, the transportation of this head saw machine is very difficult, and more labor is needed to not only move the workpiece to a location of the head saw machine, but also to transport the head saw machine.

An improved portable head saw machine is provided in the current market. This portable head saw machine comprises a head saw body, a handle attached on the head saw body for allowing the user to carry out the portable head saw machine, and a cutting blade rotatably supported on the head saw body. The user is able to conveniently carry out the portable head saw machine anywhere in order to cut a predetermined workpiece, so not only a dimension of the portable head saw machine is smaller than the conventional head saw machine, but also a weight of the portable head saw machine is lighter than the conventional head saw machine. However, the portable head saw machine has several drawbacks.

The users need to lift up the portable head saw machine by their own. Although, the weight of the portable head saw machine is relatively lighter, it is hard for the user to lift up the portable head saw machine for a long time, so the user's hands may be injured after frequently lifting the portable head saw machine up. While the head saw machine is operated for cutting workpiece along cutting lines, such as a straight line or a determined line, it is difficult for the users to control the head saw machine for cutting along the cutting lines, so as to decrease the efficiency for operating the portable head saw machine.

SUMMARY OF THE PRESENT INVENTION

The invention is advantageous in that it provides a head saw machine with a self-contained docking arrangement which is adapted to perform a handhold position and a self-stand position for the head saw machine.

Another advantage of the invention is to provide a head saw machine, wherein the self-contained docking arrangement comprises a standing frame pivotally connected with a head saw body through a mounting base and an extension arm to perform the handhold position and the self-stand position.

Another advantage of the invention is to provide a head saw machine, wherein, in the self-stand position, the standing frame is moved forwardly, and a supporting surface of the standing frame is overlapped on any flat surface in order to support the head saw machine standing on the flat surface.

Another advantage of the invention is to provide a head saw machine, wherein in the handhold position, the standing frame is moved rearwardly to align with a side surface of the head saw body, so a underneath of the head saw machine has a flat contour.

Another advantage of the invention is to provide a head saw machine, wherein the head saw machine comprises a front and a rear handle to allow the user for applying external forces to lift up the head saw machine.

Another advantage of the invention is to provide a head saw machine, wherein the self-contained docking arrangement comprises a resilient spring operatively connected with the standing frame and a mounting base in order to retain the self-contained docking arrangement in the handhold position and the self-stand position.

Another advantage of the invention is to provide a head saw machine, wherein a cutting blade can be changed by activating a spindle-lock device and a cutting blade retention device at the same time, so that the user can one hand to hold the spindle-lock device in place and use the other hand to unlock the cutting blade retention device.

Another advantage of the invention is to provide a head saw machine, wherein a cutting blade guide is rotatably attached on a head saw body of the head saw machine to cover on a top portion of the cutting blade for not only provide a protective effect but also adjust a cutting area of the cutting blade.

Another advantage of the invention is to provide a head saw machine, wherein all parts of the head saw machine is exposed and accessible, so it is very convenient for the user to maintain and repair the parts of the head saw machine.

Additional advantages and features of the invention will become apparent from the description which follows, and may be realized by means of the instrumentalities and combinations particular point out in the appended claims.

According to the present invention, the foregoing and other objects and advantages are attained by a self-contained docking arrangement for a head saw machine, wherein the head saw machine comprises:

a head saw body;

a self-contained docking arrangement to perform a handhold position and a self-stand position to the head saw machine;

a motor; and a cutting blade rotatably connected with the motor.

In accordance with another aspect of the invention, the present invention comprises a method for changing a cutting blade of a head saw machine, wherein the method comprises steps of:

1. forwardly moved a standing frame of the head saw machine until a supporting surface of a standing frame is overlapped on any flat surface to support the head saw machine standing on the flat surface;

2-1. manipulating a spindle-lock device of a motor of the head saw machine; and 2-2. unlocking a cutting blade retention device to release the cutting blade.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
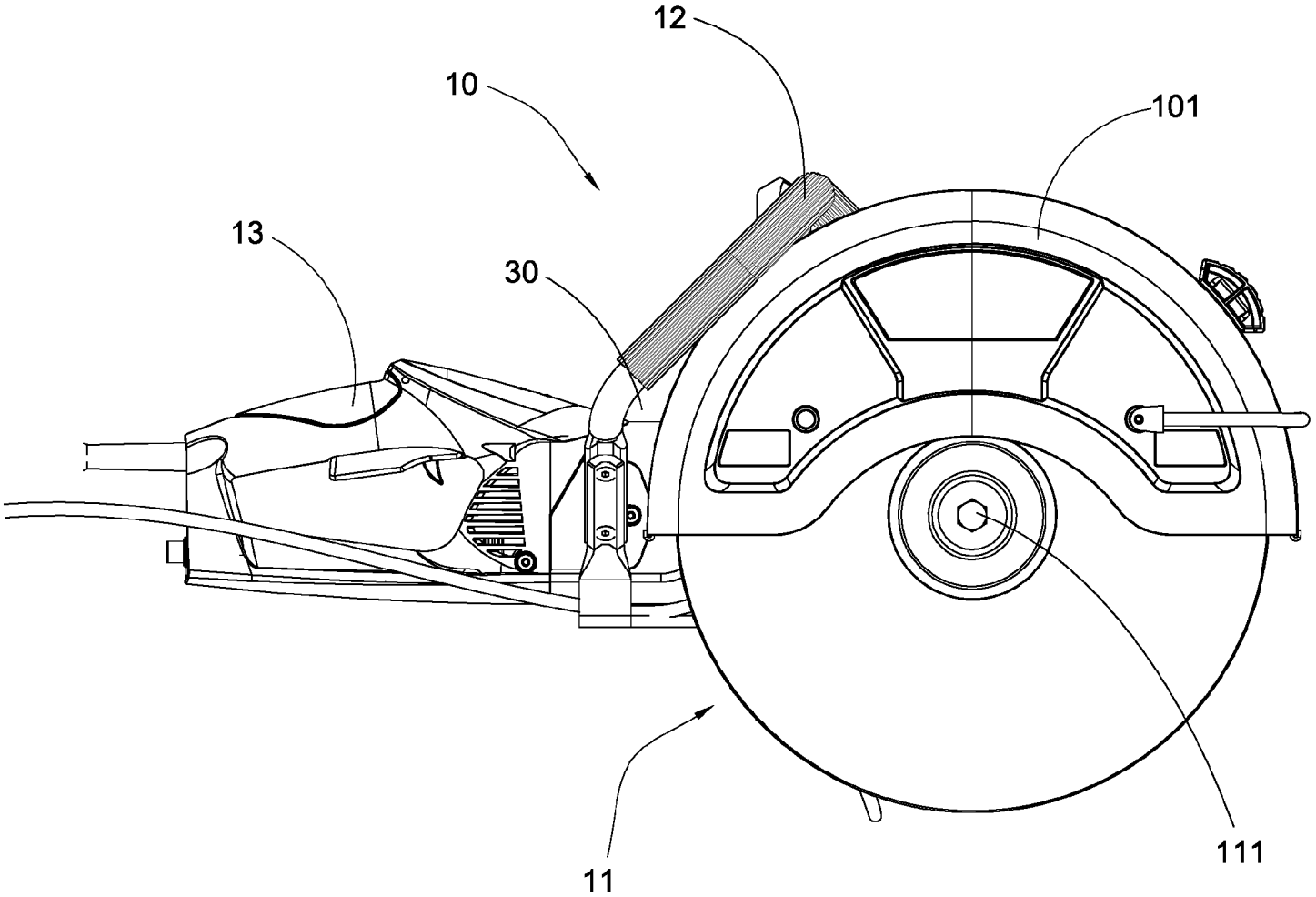
FIG. 1 is a side view of a self-contained docking arrangement for a head saw machine according to a preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIG. 1 to FIG. 4 of the drawings, a head saw machine with a self-contained docking arrangement according to a preferred embodiment of the present invention is illustrated, wherein the head saw machine comprises a head saw body 10, a cutting blade 11 rotatably supported on the head saw body 10, and a front handle 12 attached adjacent a front end of the head saw body 10, a rear handle 15 integrally extended from a position adjacent to a rear end of the head saw body 10, and a self-contained docking arrangement 20 arranged on align a side surface of the head saw body 10, wherein the self-contained docking arrangement 20 is adapted to operate a handhold position and a self-stand position, and the user is able to operate the head saw machine by holding the front and rear handle 12, 13. It is worth to mention that the head saw machine further comprises a motor 30 having an output link operatively lined with the cutting blade 12 to activate a rotation of the cutting blade 11.

Figure 2:
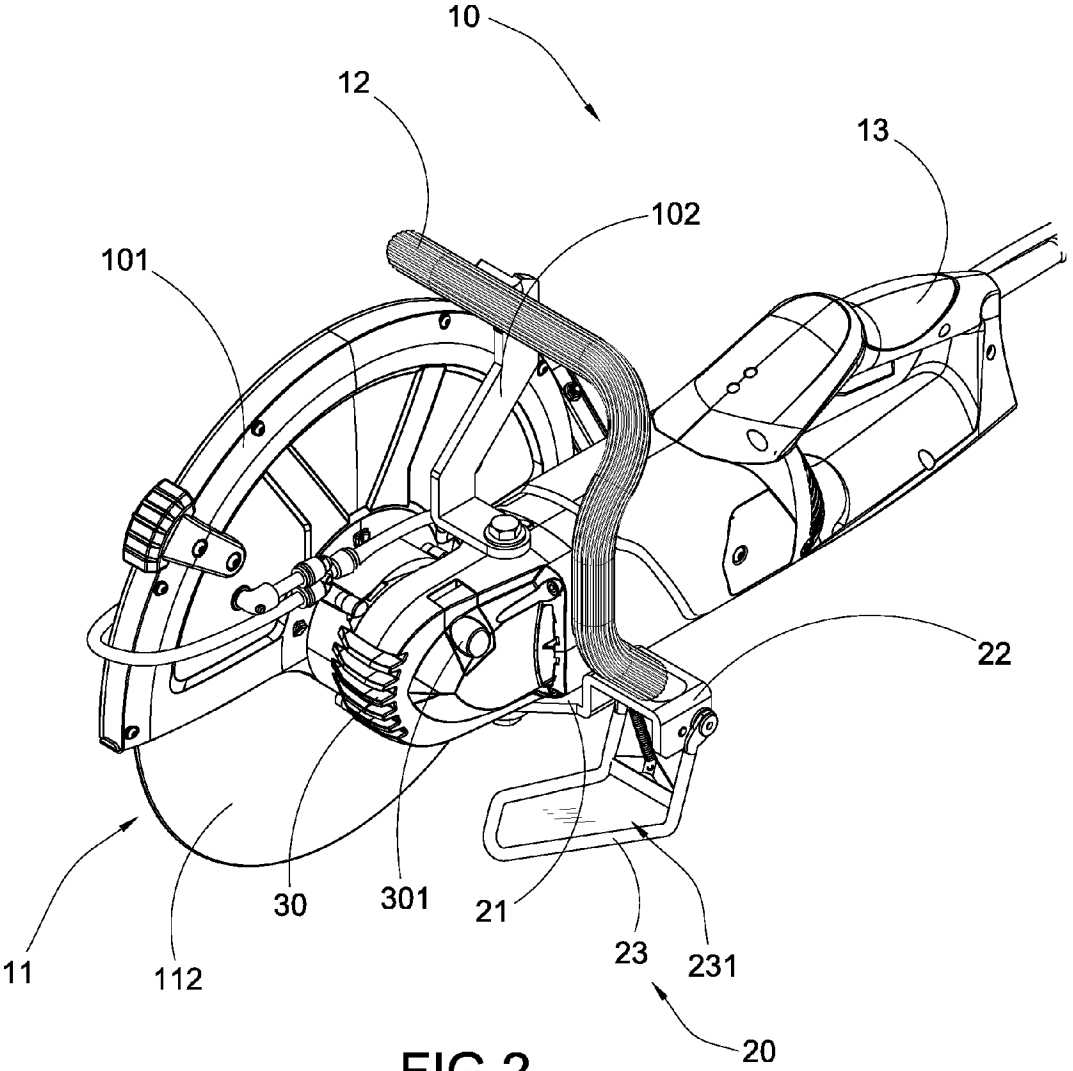
FIG. 2 is a perspective view of a self-contained docking arrangement for a head saw machine according to the above mentioned preferred embodiment of the present invention.
Figure 3:
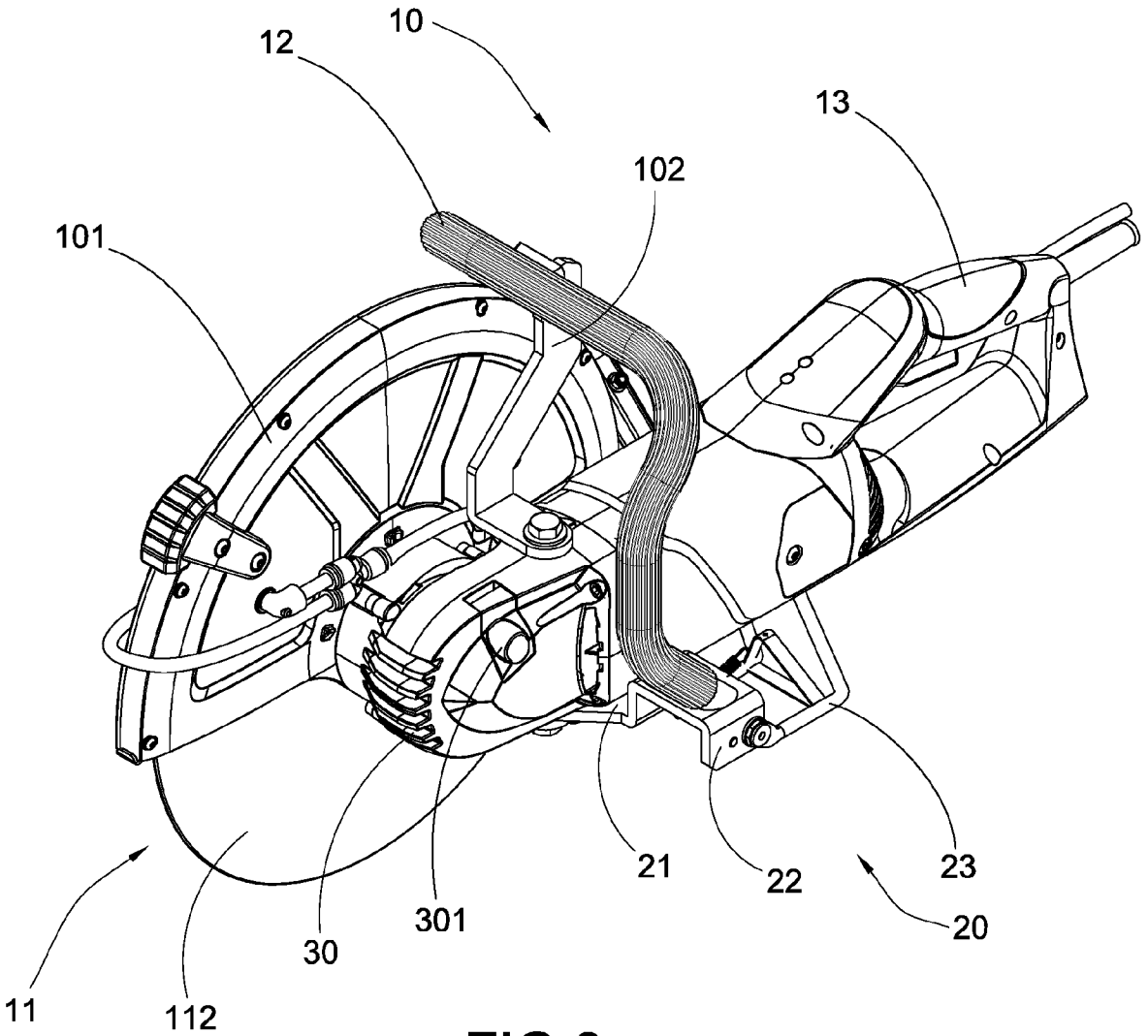
FIG. 3 is a perspective view of a self-contained docking arrangement for a head saw machine according to the above mentioned preferred embodiment of the present invention, illustrating the self-contained docking arrangement being in the handhold position.
Figure 4:
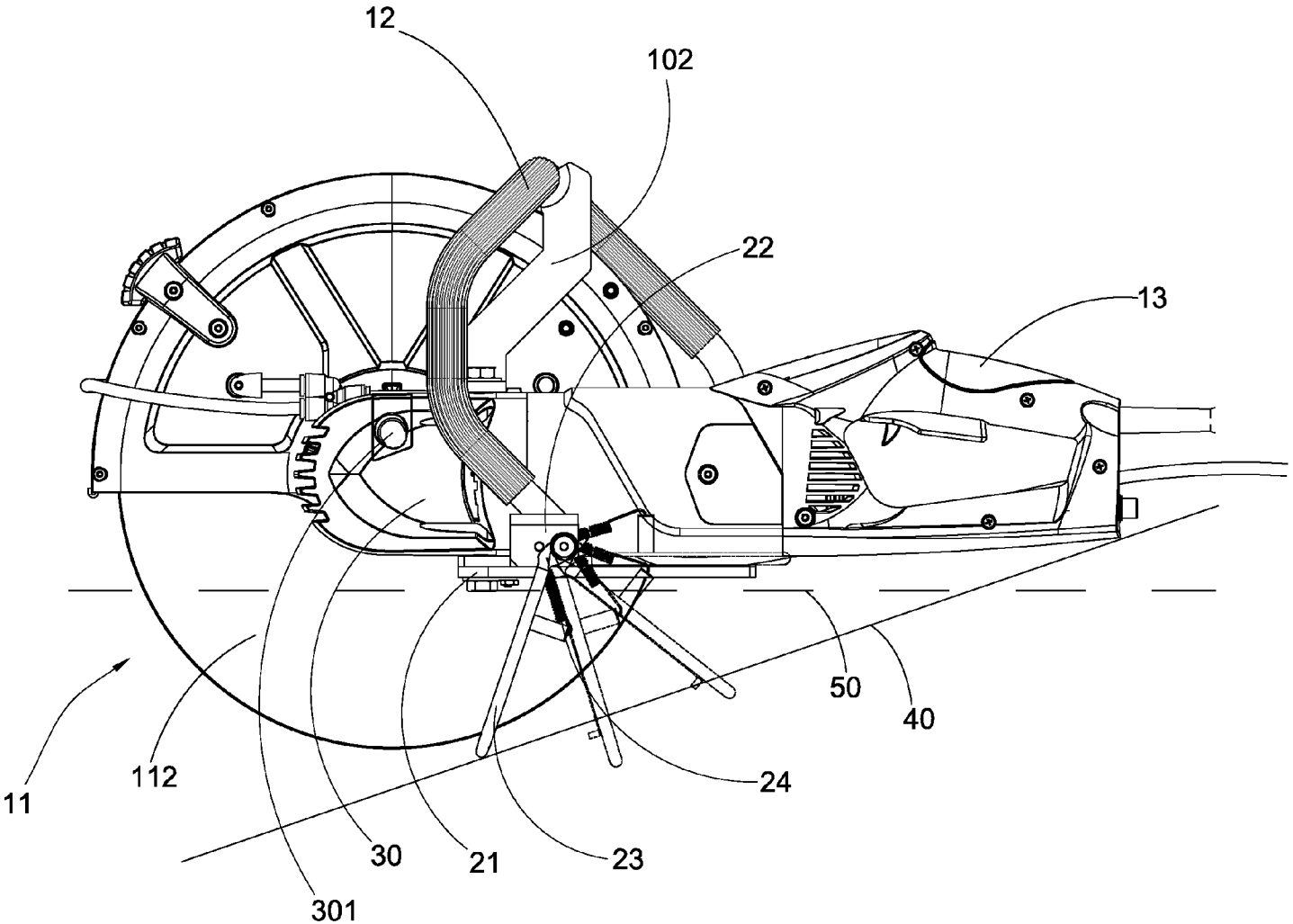
FIG. 4 is a side view of a self-contained docking arrangement for a head saw machine according to the above mentioned preferred embodiment of the present invention, illustrating the self-contained docking arrangement being changing from a self-stand position to a handhold position.
Figure 5:
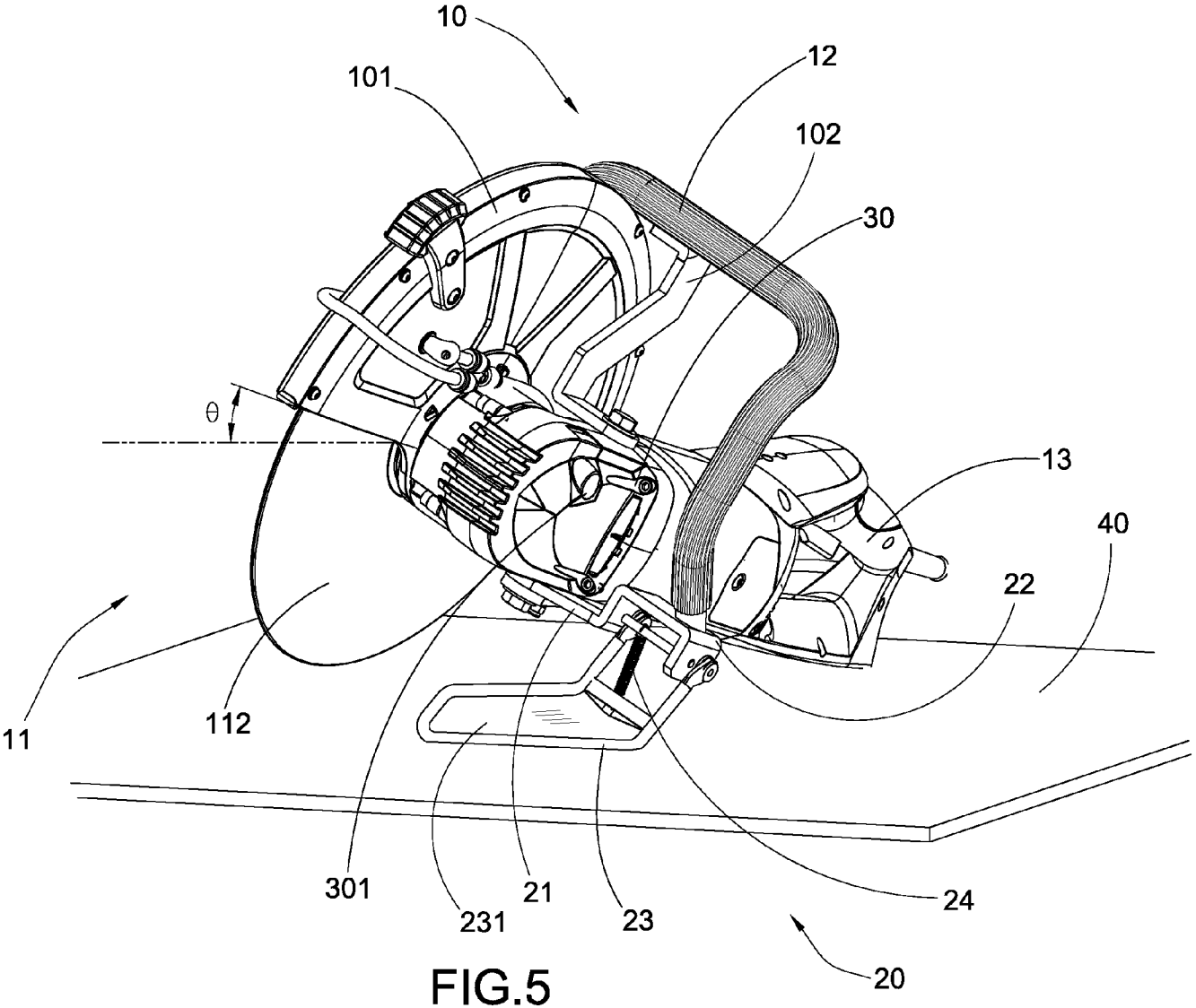
FIG. 5 is a perspective view of a self-contained docking arrangement for a head saw machine according to the above mentioned preferred embodiment of the present invention, illustrating that the head saw machine is standing on any flat surface by the self-contained docking arrangement.

As shown in FIG. 2, FIG. 4, and FIG. 5, the self-contained docking arrangement 20 comprises an extension arm 21 transversely extended from the head saw body 10, a mounting base 22 integrally extended from the extension arm 21 to support the front handle 12 arranged thereon, a standing frame 23 pivotally connected with to the mounting base 22 to perform the handhold position and the self-stand position, and a resilient spring 24 having one end attached on the mounting base 22 and the other attached on the standing frame 23. While the self-contained docking arrangement 20 is in the self-stand position, the standing frame 23 is pivotally moved forward with respect to the mounting base 22, and then the resistant spring 24 is expanded to generate a tensile force to retain the standing frame 23 in the self-stand position. Preferably, the standing frame 23 is a U-shaped standing leg, and the standing frame 23 comprises a supporting surface 231 to support the standing frame 23 standing on any flat surface 40, and in other words, the head saw machine can be supported to stand on the flat surface 40 by the supporting surface 231 of the standing frame 23 of the self-contained docking arrangement 20.

Figure 6:
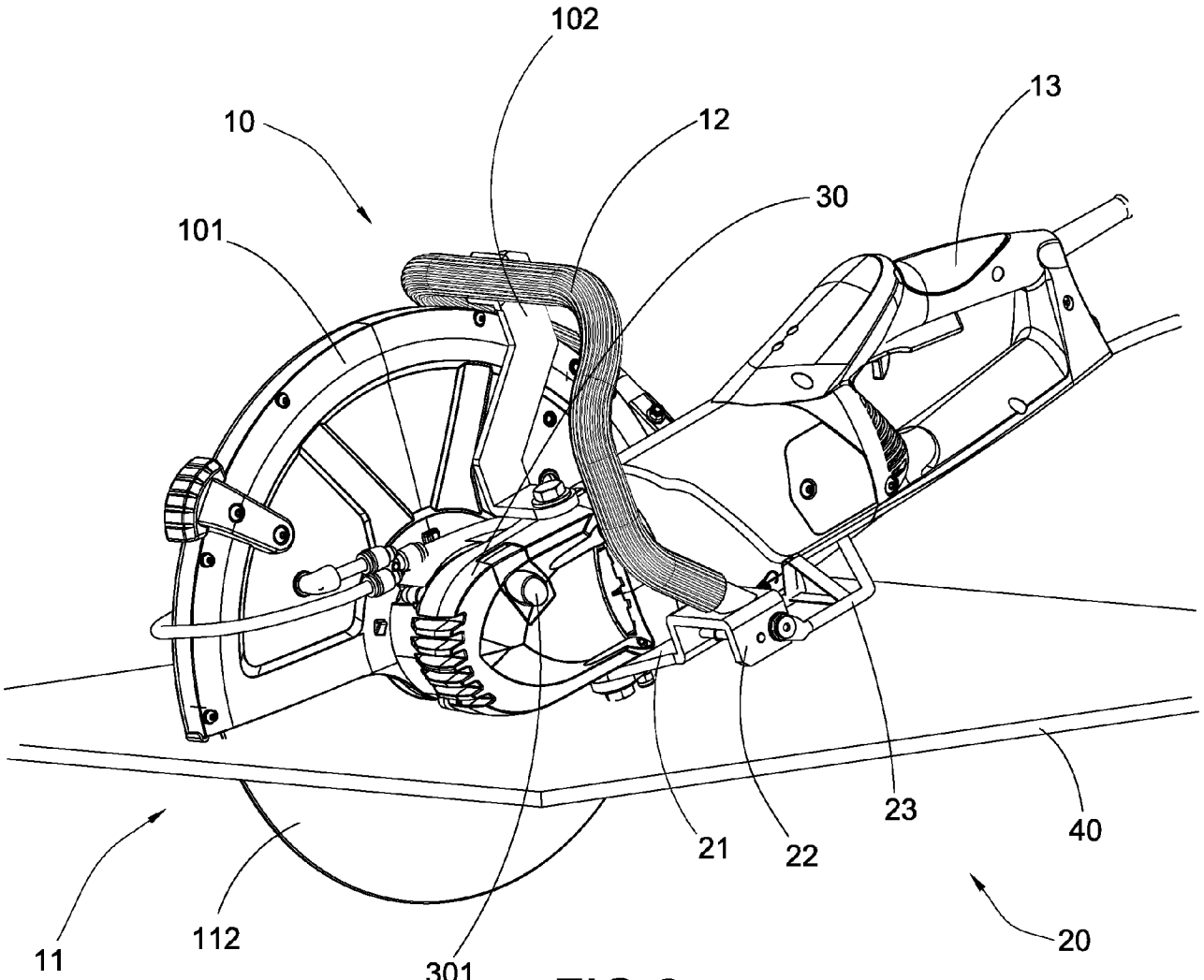
FIG. 6 is a perspective view of a self-contained docking arrangement for a head saw machine according to the above mentioned preferred embodiment of the present invention, illustrating the self-contained docking arrangement being in the handhold position to operate the hand saw machine cutting a workpiece.

As shown in FIG. 4 and FIG. 6, in the handhold position, the standing frame 23 is pivotally moved backward with respect to the mounting base 22 to align with a side surface of the head saw body 10, and in other words, the supporting surface 231 of the standing frame 23 is aligned with the bottom surface of the head saw body 10, so that no obstruction is formed on the bottom area of the head saw machine in the handhold position. In other words, while the head saw machine is in the handhold position, the underside of the head saw machine has a flat contour.

In addition, the user can hold the head saw machine on by the front and rear handle 12, 13 to easily manipulate the operation of the hand saw machine. At the same time, the resilient spring 24 is expanded while the standing frame 23 is moved backwardly in the handhold position, and then the resilient spring 24 is retracted to its original length.

It is worth to mention that the cutting blade 11 comprises a cutting blade retention device 111 to communicate the cutting blade 11 and the head saw body 10 with each other. And, the motor 30 comprises a spindle-lock device 301 to being used to releasing the cutting blade 11. Therefore, in order to change the cutting blade 11, the cutting blade retention device 111 and the spindle-lock device 301 must to be activated at the same time in order to release the cutting blade 11. For example, the user can manipulate the spindle-lock device 301 by one hand, and use an auxiliary tool to activate the cutting blade retention device 111 by the other hand in order to release the cutting blade 11. At the same time, the user can release the cutting blade 11 while the head saw machine is in the self-stand position, so it is very easy for the user to change the cutting blade 11 by himself/herself, and further prevent accidents happened during changing the cutting blade 11.

Accordingly, the head saw body 10 further comprises a cutting blade guide 101 rotatably attached on the head saw body 10 and covered on a top portion of the cutting blade 11. Preferably, the cutting blade guide 101 is a half-moon shape. And, a certain degree θ is defined as a rotation angle of the cutting blade guide 101. It is worth to mention that the cutting blade 11 comprises a cutting area 112 to be applied to cut a workpiece 50. In the normal situation, the cutting area 112 of the cutting blade 11 is defined on a bottom portion of the cutting blade 11. And, while the cutting blade guide 101 is rotated along its center at the certain degree θ, a front portion of the cutting area 112 of the cutting blade 11 is moved upward slightly. Furthermore, while the user is cutting the workpiece 50 during a forward movement or a backward movement, the cutting blade guide 101 is upwardly rotated at the certain degree θ in order to facilitate the cutting blade 11 being forwardly and backwardly cutting the workpiece 50.

Furthermore, the cutting blade guide 101 covered on the top portion of the cutting blade 11 is able to provide the protective effect for the user. It is worth to mention that while the user uses the head saw machine to cut the workpiece 50, a part of the cutting blade 11 is defined as the cutting area 112 to cut the workpiece 50, and the remaining part of the cutting blade 11 is covered by the cutting blade guide 101 to protect someone stepping-on or damaged by the cutting blade 11, so as to provide the user a safety way to operate the head saw machine.

Accordingly, the head saw body 10 further comprises a retention arm 102 having one end connected on the head saw body 10, and the other end is connected with the front handle 12. In addition, one end of front handle 12 is connected with the cutting blade guide 101, and the other end of the front handle 12 is connected with the mounting base 22, so that the front handle 12 is connected to the cutting blade guide 101, the mounting base 22, and the head saw body 10. And, the rear handle 13 is integrally formed on the rear portion of the head saw body 10. In such a manner, the gravities of the head saw body 10, the self-contained docking arrangement 20, and the cutting blade 11 can be offset while an external force, such as a lifting up force, exerted by the user is applied on the front and rear handle 12, 13.

A method for changing a cutting blade 11 for a head saw machine according to a preferred embodiment of the present invention is illustrated, wherein the head saw machine comprises a head saw body 10, a self-contained docking arrangement 20 having a standing frame 23 to support the head saw machine standing on any flat surface 40, a motor 30 having a spindle-lock device 301 to lock the cutting blade 11 with the motor 30, and a cutting blade 11 operatively connected with the motor 30 through a cutting blade retention device 101 to be driven for rotating to cut the workpiece 50.

Accordingly, the self-contained docking arrangement 20 further comprises an extension arm 21 transversely extended from a side surface of the head saw body 10, and a mounting base 22 integrally extended from the extension arm 21 to support the front handle 12 arranged thereon, wherein the standing frame 23 is pivotally connected with the mounting base 22 to perform a self-stand position.

It is worth to mention that the self-contained docking arrangement 20 further comprises a resilient spring 24 having one end attached on the mounting base 22 and the other attached on the standing frame 23. While the self-contained docking arrangement 20 is in the self-stand position, the standing frame 23 is pivotally moved forward with respect to the mounting base 22, and then the resistant spring 24 is expanded to generate a tensile force to retain the standing frame 23 in the self-stand position. Preferably, the standing frame 23 is a U-shaped standing leg, and the standing frame 23 comprises a supporting surface 231 to support the standing frame standing on a flat surface.

The method for changing the cutting blade 11 for a head saw machine comprises steps of:

1. forwardly moving the standing frame 23 until the supporting surface 231 of the standing frame 23 is overlapped on any flat surface 40 to support the head saw machine standing on the flat surface 40;

2-1. manipulating the spindle-lock device 301 of the motor 30; and 2-2. unlocking the cutting blade retention device 101 to release the cutting blade 11.

Accordingly, the step 1 and 2 can be operated at the same by two hands of one person, so it is very easy for the user to change the cutting blade 11 by himself/herself, wherein the cutting blade retention device 101 can be unlocked by a supplemental tool, such as a spanner or wrench.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A head saw machine, comprising:

a head saw body;

a self-contained docking arrangement to perform a handhold position and a self-stand position to the head saw machine;

a motor having an output line; and a cutting blade rotatably connected with said output link of said motor.

2. The head saw machine, as recited in claim 1, further comprising and a front handle attached adjacent a front end of said head saw body, and a rear handle integrally extended from a position adjacent to a rear end of said head saw body, which allow the user holding thereon.

3. The head saw machine, as recited in claim 2, wherein said self-contained docking arrangement is arranged on a bottom portion of said head saw body.

4. The head saw machine, as recited in claim 2, wherein said self-contained docking arrangement comprises an extension arm transversely extended from a bottom surface of said head saw body, a mounting base extended from said extension arm to support said front handle arranged thereon, a standing frame pivotally connected with said mounting base to perform said handhold position and said self-stand position, and a resilient spring having one end attached on said mounting base and the other end attached on said standing frame.

5. The head saw machine, as recited in claim 4, wherein said standing frame is a U-shaped standing leg having a supporting surface to support said standing frame standing on any flat surface.

6. The head saw machine, as recited in claim 4, wherein while said self-contained docking arrangement is in said self-stand position, said standing frame is pivotally moved forward with respect to said mounting base, and then said resistant spring is expanded to generate a tensile force to retain said standing frame in said self-stand position.

7. The head saw machine, as recited in claim 4, wherein said standing frame is pivotally moved backward with respect to said mounting base to align with a side surface of said head saw body in said handhold position, and said resilient spring is expanded to generate a tensile force to retain said standing frame in said aligned position.

8. The head saw machine, as recited in claim 4, wherein the user can hold on said head saw machine by said front and rear handle to easily manipulate the operation of said hand saw machine.

9. The head saw machine, as recited in claim 4, wherein said cutting blade comprises a cutting blade retention device to communicate said cutting blade and said head saw body, and said motor comprises a spindle-lock device to lock said cutting blade with said motor.

10. The head saw machine, as recited in claim 9, wherein said cutting blade retention device and said spindle-lock device must to be activated at the same time to release said cutting blade.

11. The head saw machine, as recited in claim 4, wherein said head saw body further comprises a cutting blade guide rotatably attached on said head saw body by a rotation angle, defined as a certain degree θ and covered on a top portion of said cutting blade.

12. The head saw machine, as recited in claim 11, wherein said cutting blade comprises a cutting area applied to cut a workpiece, while said cutting blade guide is rotated along its center at said certain degree θ, a front portion of said cutting area of said cutting blade is slightly moved upward.

13. The head saw machine, as recited in claim 11, wherein said cutting blade guide is a half-moon shape.

14. The head saw machine, as recited in claim 4, wherein said head saw body comprises a retention arm having one end connected with said head saw body, and the other end is connected with said front handle for securely connecting said front handle with the head saw body.

15. The head saw machine, as recited in claim 14, wherein one end of said front handle is connected with said cutting blade guide, and the other end of said front handle is connected with said mounting base, so that said front handle is connected to said cutting blade guide, said mounting base, and said head saw body, which can evenly distribute an external force to offset gravities of said cutting blade guide, said mounting base, and said head saw body.

16. A method for changing a cutting blade for a head saw machine a head saw machine comprising steps of:

a. forwardly moving a standing frame until a supporting surface of said standing frame is overlapped on any flat surface to support said head saw machine standing on said flat surface;

b-1. manipulating a spindle-lock device of a motor; and b-2. unlocking a cutting blade retention device to release said cutting blade.

17. The method, as recited in claim 16, wherein said step b.1 and b.2 must be operated at the same time in order to release said cutting blade.

18. The method, as recited in claim 16, wherein said standing frame is a U-shaped standing leg.

19. The method, as recited in claim 16, wherein said cutting blade retention device can be unlocked by a supplemental tool.

20. The method, as recited in claim 16, wherein said head saw machine comprises a head saw body, a self-contained docking arrangement having said standing frame, said motor having said spindle-lock device, and said cutting blade operatively connected with said motor by said cutting blade retention device.

21. The method, as recited in claim 20, wherein said self-contained docking arrangement comprises an extension arm transversely extended from a bottom surface of said head saw body, and a mounting base extended from said extension arm to support the front handle arranged thereon, wherein said standing frame is pivotally connected with to said mounting base.

22. The method, as recited in claim 20, wherein said self-contained docking arrangement further comprises a resilient spring having one end attached on said mounting base and the other attached on said standing frame.

23. The method, as recited in claim 20, wherein said resistant spring is expanded to generate a tensile force to retain said standing frame in a self-stand position.

* * * * *